US006736785B1

(12) United States Patent
Van Brunt

(10) Patent No.: US 6,736,785 B1
(45) **Date of Patent: *May 18, 2004**

(54) MECHANICAL CHEST WALL OSCILLATOR

(75) Inventor: Nicholas P. Van Brunt, White Bear Lake, MN (US)

(73) Assignee: Advanced Respiratory, Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/754,672

(22) Filed: Jan. 4, 2001

Related U.S. Application Data

(63) Continuation-in-part of application No. 09/370,742, filed on Aug. 9, 1999, now abandoned.

(51) Int. Cl.[7] ..... A61H 31/00
(52) U.S. Cl. ..... 601/44
(58) Field of Search ..... 601/41–44, 148–152

(56) References Cited

U.S. PATENT DOCUMENTS 1,646,590 A 10/1927 Mildenberg
2,486,667 A 11/1949 Meister
3,460,531 A * 8/1969 Gardner ..... 128/87
3,802,417 A * 4/1974 Lang ..... 340/526
4,397,306 A 8/1983 Weisfeldt et al.
4,453,538 A * 6/1984 Whitney ..... 128/DIG. 20
4,624,244 A * 11/1986 Taheri ..... 128/DIG. 15
4,838,263 A 6/1989 Warwick et al.
4,977,889 A 12/1990 Budd
5,056,505 A 10/1991 Warwick et al.
5,455,159 A 10/1995 Mulshine et al. ..... 435/7.23
5,496,262 A * 3/1996 Johnson et al. ..... 601/152
5,738,637 A * 4/1998 Kelly et al. ..... 601/41
5,769,797 A 6/1998 Van Brunt et al. ..... 601/41
5,769,800 A * 6/1998 Gelfand et al. ..... 601/151
5,891,062 A 4/1999 Schock et al. ..... 601/41
6,174,295 B1 * 1/2001 Cantrell et al. ..... 601/41

* cited by examiner

*Primary Examiner*—Danton D. DeMille
(74) *Attorney, Agent, or Firm*—Barnes & Thornburg

(57) ABSTRACT

A portable high frequency chest wall oscillation (HFCWO) apparatus for the purposes of airway lung clearance and ventilation includes a circumferential chest band which is placed around a person's chest and a drive which is connected to the chest band for cyclically varying the circumference of the chest band to apply an oscillating compressive force to the chest of the person. The apparatus maintains the oscillating compressive force applied by the chest band to the chest of the person at a substantially constant level such that the person is able to continue chest expansions and contractions during a breathing cycle.

53 Claims, 9 Drawing Sheets

MECHANICAL CHEST WALL OSCILLATOR

CROSS-REFERENCE TO RELATED APPLICATION(S)

This application is a continuation-in-part of application Ser. No. 09/370,742, filed Aug. 9, 1999, now abandoned for "Mechanical Chest Wall Oscillator" by Nicholas P. Van Brunt.

BACKGROUND OF THE INVENTION

The present invention relates to chest compression devices and in particular to a high frequency chest wall oscillator device.

In a variety of diseases such as cystic fibrosis, emphysema, asthma, and chronic bronchitis, the mucus that collects in the tracheobronchial passages is difficult to remove by coughing. This may be due to the characteristics of the mucus (such as its quantity or viscosity, or both), or because the patient does not have the strength or lung capacity to produce an adequate cough. Manual percussion techniques of chest physiotherapy are labor intensive, uncomfortable, and make the patient dependent on a care giver. As a result, devices and methods for airway clearance, such as the use of a chest compression device, have been developed.

A chest compression device useful for airway clearance should meet a number of criteria based on human factors, engineering, and common sense. First, it must be safe to operate. Second, it should provide some degree of user control. Third, it should be easy to understand and operate. Fourth, it should minimize the intrusion into the daily activities of the user. Fifth, the device should be highly reliable. Sixth, it should be of a design which does not result in unusual service requirements for the device. Seventh, the weight and bulk of the device should be reduced to a point that foreseeable users can maneuver the device. Eighth, the device must be able to provide adequate force over a relatively large surface area in an energy efficient manner so it can be operated from AC or battery.

A successful method of airway clearance makes use of high frequency chest wall oscillation (HFCWO). The device most widely used is the ABI Vest Airway Clearance System by American Biosystems, the assignee of the present application. The ABI Vest System is a pneumatically driven system, in which an air bladder is positioned around the chest of the patient and is connected to a source of air pulses. A description of this type of system can be found in the Van Brunt et al. patent, U.S. Pat. No. 5,769,797 which is assigned to American Biosystems.

Other chest compression devices have also been used or described in the past. For example, the Warwick et al. patent, U.S. Pat. No. 4,838,263 describes another pneumatically driven chest compression device. Mechanical vibrators and direct mechanical compression devices have also been used to produce high frequency chest wall oscillators.

In the pneumatic system described in the Van Brunt et al. patent, an air pulse generator is connected to the air bladder contained in a vest which is positioned around the chest of the patient. The air pulse generator provides a pulsed source of air in conjunction with an adjustable static source of air. The static air pressure acts as a "bias line" around which the pulses of air pressure from the pulse source are referenced. Thus, an increase in the static pressure has the effect of oscillating the chest wall with greater intensity despite the pressure change (Delta) of the pulsed waveform (max to min.) remaining constant.

Pneumatically driven HFCWO produces substantial transient increases in the airflow velocity with a small displacement of the chest cavity volume, increases in cough-like shear forces, and reductions in mucus viscosity resulting in a unidirectional increased upward motion of the mucus through the bronchioles.

The pneumatic system as disclosed in the Van Brunt et al. patent and as implemented in the ABI Vest System from American Biosystems has been a very successful and widely used method for airway clearance. The pneumatic system meets the first six requirements of a chest compression device, but could be improved with respect to bulk, weight, and energy efficiency.

BRIEF SUMMARY OF THE INVENTION

The present invention is a chest wall oscillator device that performs the function of loosening and assisting in the removal of excess mucus from a person's lungs. The chest wall oscillator includes a chest band having first and second ends for placement around a person's chest, a drive unit connected to the chest band cyclically varies the circumference of the chest band to apply an oscillating compressive force to the chest of the person. The chest wall oscillator also includes a means for maintaining the oscillating compressive force applied by the chest band to the chest of the person at a substantially constant level such that the person is able to continue chest expansions and contractions as during regular breathing.

In preferred embodiments of the present invention, an air bladder is placed on the inner surface of the chest band for engaging the chest of the person and applying a "bias line" pressure to the person's chest. The drive unit preferably includes a motor which is connected to the first end of the chest band and a linkage which is connected to the second end of the chest band. The linkage is driven by the motor to cyclically move the second end of the chest band relative to the first end of the chest band, thereby effectively varying the circumference of the chest band around the person's chest and producing the oscillating compressive force.

DETAILED DESCRIPTION

Figure 1:
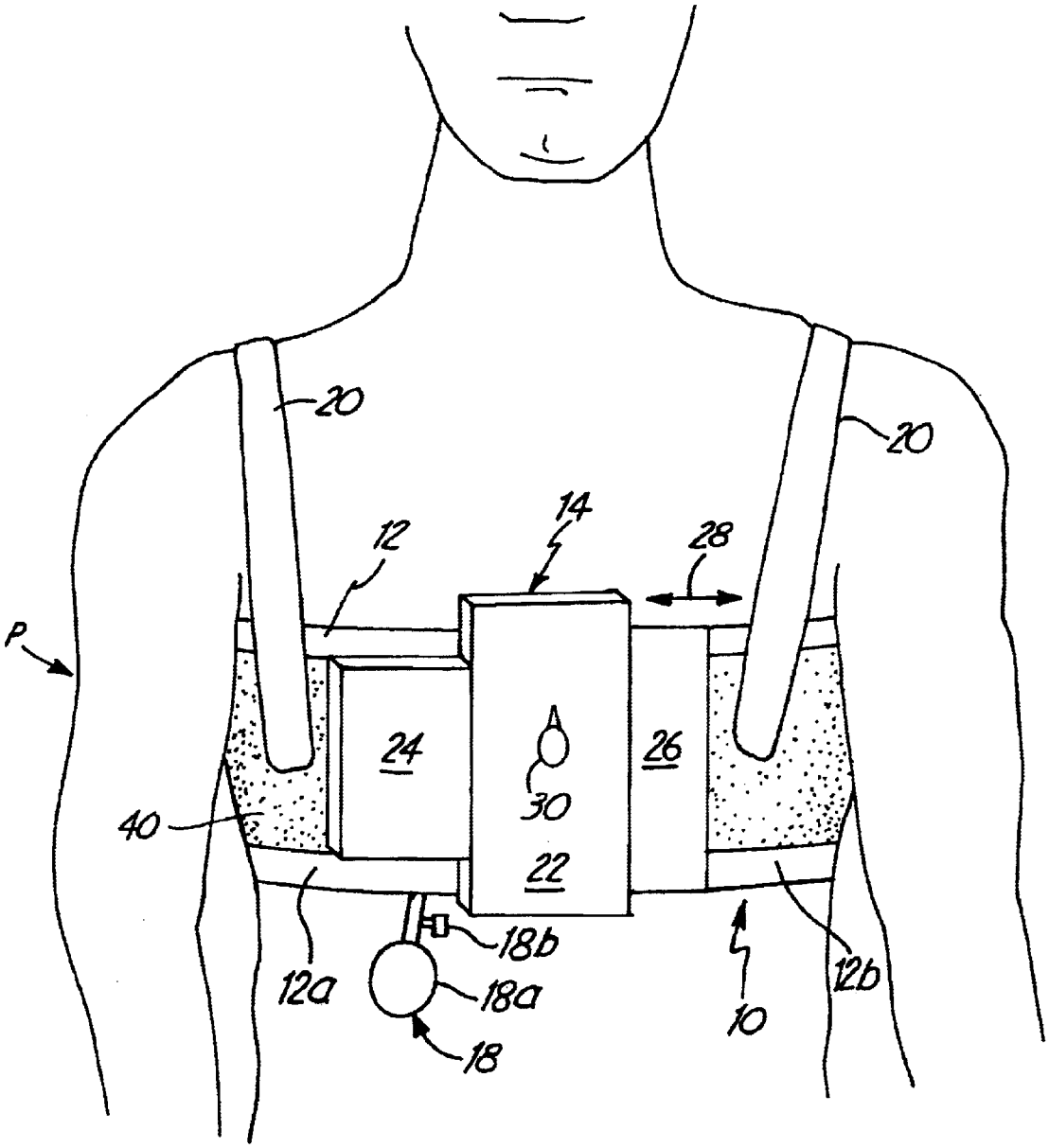
FIG. 1 is a perspective view showing a first embodiment of a chest wall oscillator of the present invention, positioned around a person's chest.
Figure 2:
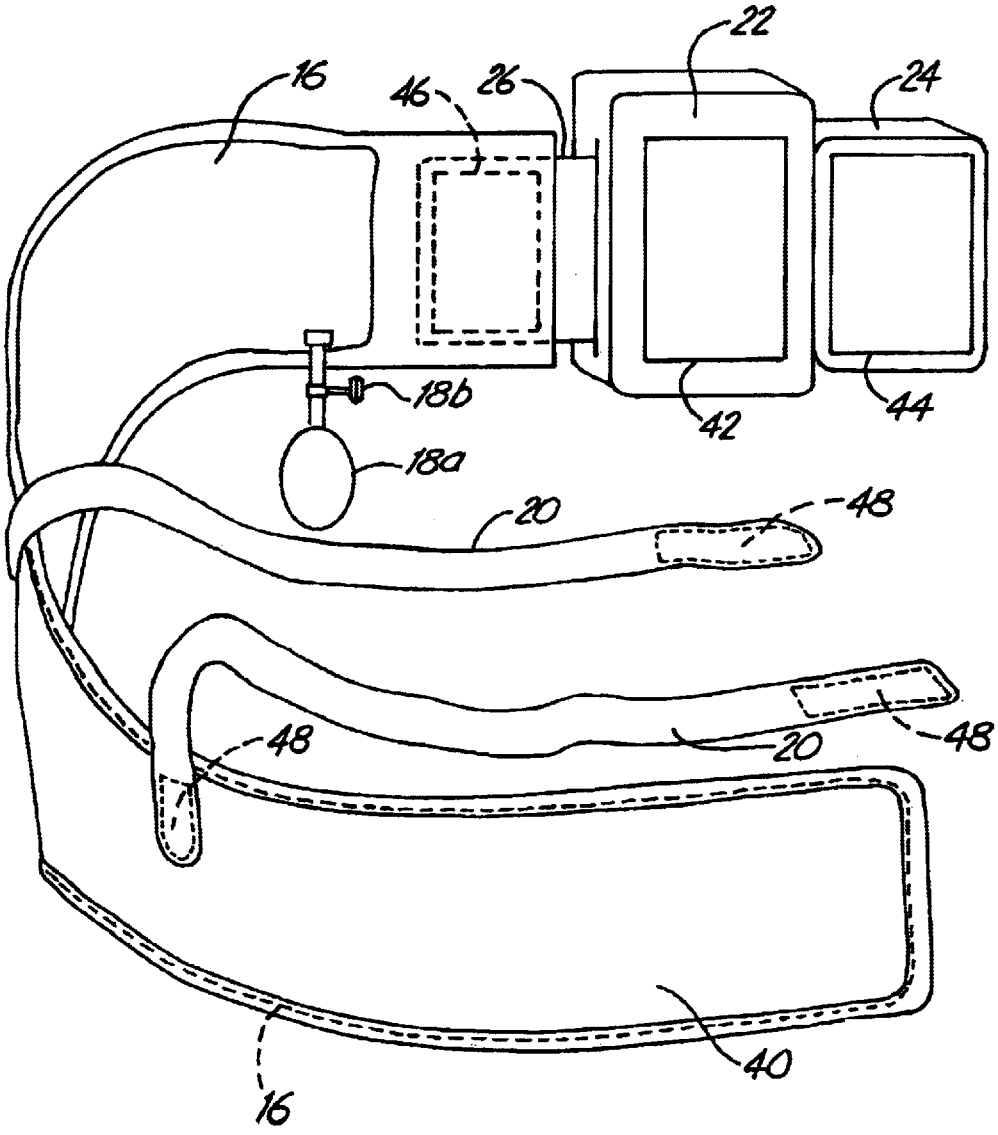
FIG. 2 is a perspective view of the chest wall oscillator of FIG. 1 removed from the patient.

FIGS. 1 and 2 show a chest wall oscillator 10 of the present invention. FIG. 1 shows the chest wall oscillator in its normal operating position placed around the chest of patient P, who is receiving HFCWO air clearance therapy, while FIG. 2 shows oscillator 10 removed from patient P. Chest wall oscillator 10 is a light weight, easy to use, battery powered device that can be used to loosen and assist in the removal of excess mucus from the person's lungs.

In the embodiment shown in FIGS. 1 and 2, chest wall oscillator 10 includes a chest band 12, a drive unit 14, an air bladder 16 (shown in FIG. 2), an inflation device 18, and suspender straps 20.

Chest band 12 is a generally rectangular, non-flexible stretch material which extends around the person's chest. Chest band 12 must be sufficiently flexible so that it will conform generally to the shape of the person's chest, yet must be essentially inelastic in the circumferential direction. Chest band 12 has a first free end 12*a* and a second free end 12*b* which, as shown in FIG. 1, are positioned at the front of the person's chest.

Though shown with drive unit 14 positioned at the front of the person's chest, drive unit 14 can also be positioned at the person's back. Some individuals may find this positioning more comfortable.

Drive unit 14 includes a motor housing 22, a battery power pack 24, and a linkage 26. Motor housing 22 and battery power pack 24 are removably connected to first end portion 12*a* of chest band 12. Linkage 26, which extends out of one side of motor housing 22, and is movable in a generally horizontal direction as illustrated by double headed arrow 28, is removably attached to second end portion 12*b* of chest band 12.

Motor housing 22 contains a motor and associated electrical control circuitry which is used to move linkage 26 back and forth in the direction illustrated by arrow 28. User control knob 30 on the front surface of motor housing 22 is a part of the control circuitry, and allows the user to select the oscillation frequency at which linkage 26 is moved.

Air bladder 16 (as seen in FIG. 2) is mounted on the inner surface of chest band 12. Bladder 16 is inflatable through the use of inflation device 18 so that the inner surface of bladder 16 conforms to the person's chest. Air bladder 16 is preferably formed by a flexible polymeric liner which is bonded to the inner surface of the chest band 12. Inflation device 18 includes inflation bulb 18*a* and pressure relief mechanism 18*b*. In use, air bladder 16 is pumped (using inflation device 18) to a level which provides a firm but comfortable fit around the person's chest. The compression force over the surface area of the chest band being applied to the patient's chest should be similar to that of a snug air bladder pneumatic system operating at about 0.5 psi. The static force of the chest band is determined by the amount of air pressure in bladder 16, which can be inflated and deflated by the user using inflation device 18. However, the device is also effective without air bladder 16, which is primarily included to improve comfort and provide a uniform body-conforming fit.

Suspender straps 20 are attached to chest band 12 and extend over the person's shoulders to hold the chest band 12 in its desired position around the patient's chest. Straps 20 may be adjustable in a variety of different ways (e.g. buttons, snaps, Velcro fasteners) to accommodate patients of different sizes. Some peoples body shape may allow the band to stay in position without the need for straps 20.

To use chest wall oscillator 10, the patient places chest band 12 around his or her chest, with free end sections 12*a* and 12*b* positioned at the front of the patient's chest. Suspender straps 20 are then put in place over the patient's shoulders and adjusted to maintain the position of chest band 12. Drive unit 14 is then attached to end portions 12*a* and 12*b*, if it is not already attached to one or the other of the end sections. In particular, motor housing 22 and battery pack 24 are attached to first end portion 12*a* of chest band 12. Linkage 26 is attached to second end portion 12*b*. These attachments may be made, for example, by a Velcro hook/loop fastener 40 on the outer surface of chest band 12 and fasteners 42, 44 and 46 (shown in FIG. 2) on the back sides of motor housing 22, battery pack 24 and linkage 26, respectively. Similarly, suspenders 20 are connected by fasteners 48 to fastener 40 on chest band 12. At this point, chest band 12 should be relatively snug around the person's chest.

Oscillator 10 is then energized by moving user control 30 from an off position to a position at which a particular oscillation frequency is selected. As a result, the motor within motor housing 22 moves linkage 26 in and out of motor housing 22 in the direction shown by arrow 28. Since motor housing 22 is connected to first end 12*a* and linkage 26 is connected to second end 12*b* of chest band 12, the relative movement of linkage 26 in and out of motor housing 22 effectively changes the circumference of chest band 12. As linkage 26 moves inward, it shortens the circumference of chest band 12 and applies greater compressive force to the patient's chest. When linkage 26 is driven outward, it lengthens the circumference of chest band 12 and relaxes or releases the compressive force being applied to the person's chest. The cyclical varying of the circumference of chest band 12 applies an oscillating compressive force to the person's chest. This force is supplied from chest band 12 through air bladder 16 to the chest of the patient. In preferred embodiments of the present invention, the drive frequency of oscillation is in a range of about 5 Hz to about 20 Hz.

Figure 3A:
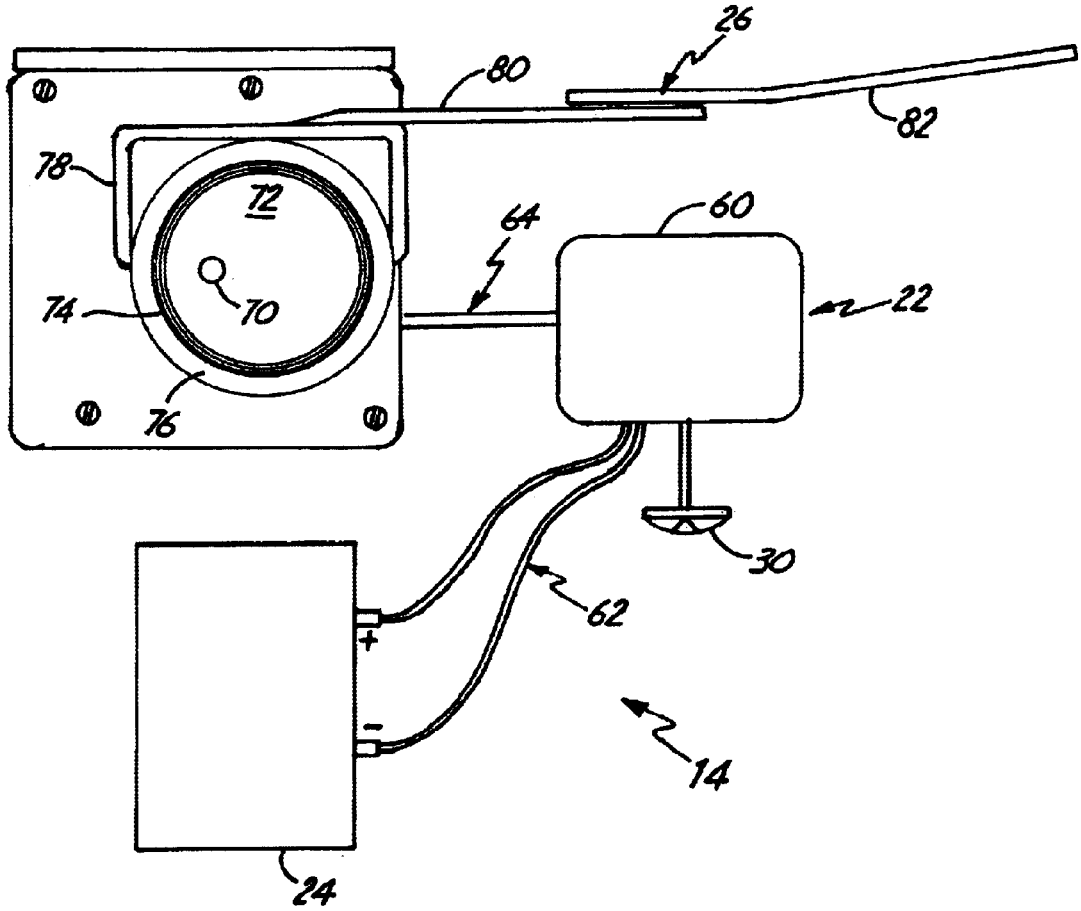
FIGS. 3A and 3B are front and top views of the drive unit of the chest wall oscillator.
Figure 3B:
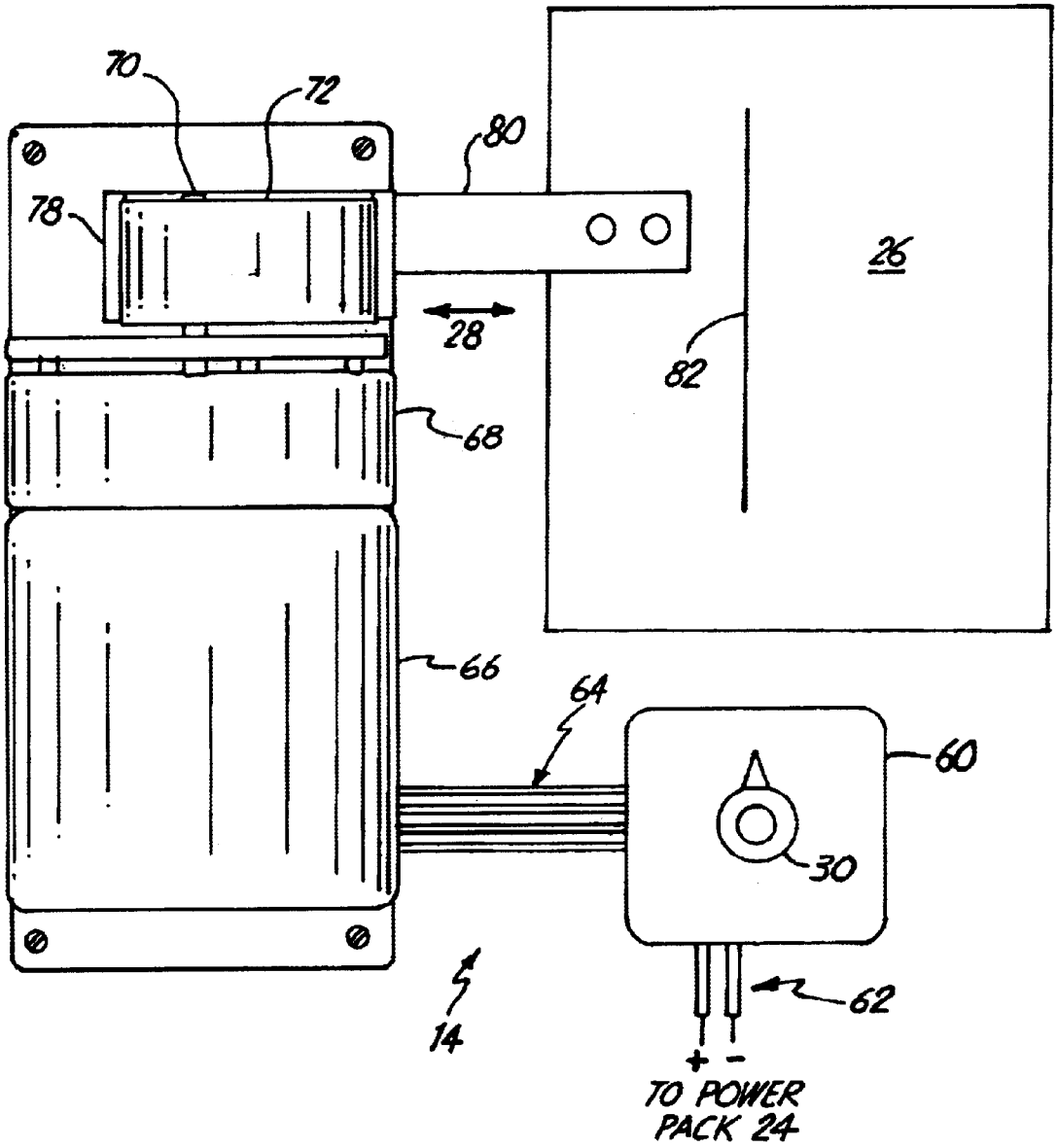

FIGS. 3A and 3B show top and front view diagrams of drive unit 14 used in all embodiments of chest wall oscillator 10, which includes motor housing 22, battery pack 24 and linkage 26. Located within motor housing 22 are an electronic control module 60, control and power wires 62 and 64, a motor 66, a gear box 68, a shaft 70, a cam 72, a bearing 74, a sleeve 76, a bracket 78, and a bracket arm 80. Linkage 26 is connected to the outer end of bracket arm 80.

Electrical power is supplied from battery power pack 24 through wires 62, to electronic control module 60. Electronic control module 60 is mechanically connected to operator control knob 30 and is electrically connected, through wires 64 to electric motor 66. Gear box 68 is mounted at the upper end of motor 66 and provides a mechanical rotating output through drive shaft 70. Cam 72 is mounted on shaft 70. Bearing 74 and sleeve 76 surround cam 72, and follow the movement of cam 72 as shaft 70 is rotated. Bracket 78 is fixed to the outer surface of sleeve 76. Together, cam 72, bearing 74, sleeve 76, bracket 78 and bracket arm 80 convert rotational movement of shaft 70 to a linear movement, illustrated by double ended arrow 28. That linear movement moves linkage 26 in and out of motor housing 22, thus alternately tightening and loosening chest band 12.

The user selects the speed of motor 66, and thus the frequency of oscillatory movement of linkage 26 through control knob 30, which is linked to electronic control module 60. For example, control knob 30 may be connected to a potentiometer which forms part of the circuitry of electronic control module 60. The speed of motor 66 is controlled by electronic control module 60 as a function of the setting of control knob 30. The speed of operation of motor 66 determines the rotational speed of shaft 70 and cam 72. The eccentric rotation of cam 72 moves bracket 78, bracket arm 80, and linkage 26 in an oscillating linear motion by a distance which is proportional to the offset of shaft 70 with respect to the center of cam 72.

In the embodiment shown in FIGS. 3A and 3B, a bend 82 is provided in linkage 26 at about the point of attachment between bracket arm 80 and linkage 26. The purpose of bend 82 is to allow linkage 26 to more closely follow the curvature of the patient's torso and provide a better connection between linkage 26 and second end 12*b* of chest band 12.

The following example provides an indication of the typical sizes, forces and other parameters of the mechanical chest wall oscillator. For the purpose of this example, an average circumference of chest band 12 is chosen to be 40 inches. A typical range of circumferences may be about 20 inches to about 50 inches. The distance of travel of linkage 26 is referred to as the "gap".

Since the pneumatic vest HFCWO (such as provided by the ABI Vest System) has been used on a large number of patients, and has demonstrated a high degree of safety and effectiveness, the forces it produces can be a primary design parameter for the portable mechanical HFCWO of the present invention. The following typical design parameters were used:

Average circumference=40"=C
Height=10"=h
Volume change with gap closure=30 $in^3=\Delta V$
P max in air bladder=0.5 psi
P min in air bladder=0 psi
Maximum oscillatory rate, f=14 Hz
Gap radius=ΔR
R=radius
A=Band area
F=closure force of gap Key equations:

$$\text{Volume}=C^2h/4\pi \text{in}^3$$

$$R\ \text{min}/R\ \text{max}=\{V\ \text{min}/V\ \text{max}\}^{1/2}$$

$$\Delta d=2\pi(R\ \text{max}-R\ \text{min})=C\ \text{max}-(C\ \text{max}^2-37.699)^{1/2}\text{in.}$$

$$F=P\ \text{max}(A2\pi)lb.$$

$$T=\Delta d\times F\times 0.0833\times f, ft-lb/\text{sec}$$

$$Hp=T/550$$

$$\text{Watts}=Hp\times 746$$

$$\text{Motor torque}=\text{Watts}/(RPM)(0.0074)\text{in-oz}$$

TABLE I

Representative design quantities calculated from above equations

| |
|---|
| Given: C = 40 inches |
| Δd = 0.47401 inches |
| Max radial force = 200 lb |
| F = 31.831 lb |
| T = 17.603 ft-lb/sec |
| Watts = 23.876 watts |
| Hp = 0.032 hp |

TABLE II

Values of gap. watts, and horsepower as a function of Circumference to produce a constant force of 0.5 PSI

| Circumference, C max, inches | Gap, Δd inches | Hp | Watts |
|---|---|---|---|
| 50 | 0.37842 | 0.025 | 19.50 |
| 45 | 0.42084 | 0.028 | 21.18 |
| 40 | 0.47405 | 0.032 | 23.87 |
| 35 | 0.54276 | 0.037 | 27.32 |
| 30 | 0.6503 | 0.043 | 37.97 |
| 25 | 0.76570 | 0.052 | 38.79 |
| 20 | 0.96579 | 0.065 | 48.63 |

Taking the 40" circumference as a "nominal value" of chest band 12, a practical range for a portable device is from 20"–50". From the equations, Table I lists numerical values for the 40" band. Based on these calculations, the gap increases slightly over one-fourth of an inch as the circumference is reduced from 50" to 30" and the gap increases slightly over one-half inch as the circumference is reduced from 50" to 20". A 0.05 horsepower motor is adequate to provide the forces for these ranges, and in many applications, a 0.032 horsepower motor is also suitable. The small motor required allows the device to be portable, lightweight, energy efficient and capable of battery-powered operation.

Table II shows that for a constant force, a smaller chest circumference requires a larger gap. Therefore, by using a constant gap (distance of travel of arm 26), smaller circumference chests will receive smaller compressive forces. This provides inherent safety in use on smaller adults and children, since the gap is preferably selected for a nominal chest circumference of, for example, 40 inches.

During cyclic variation of the chest band to apply an oscillating compressive force to the person's chest, the oscillating compressive force by the chest band must be maintained at a substantially constant level upon the person's chest to allow the person to maintain a regular breathing cycle. When a person breaths the chest expands and contracts and use of the chest wall oscillator should not impede the person's ability to breath. The present invention includes a means for maintaining the oscillating compressive force applied by the chest band upon the chest of the person substantially constant such that during cyclic variation of the chest band the person's chest is able to expand and contract as done during regular breathing.

In the preferred embodiments of the present invention, the drive frequency of oscillation is in a range of about 5 Hz to about 20 Hz. A person's breathing cycle generally has a frequency of about 1 cycle per four seconds or 0.25 Hz. The oscillated forces are therefore 20 to 80 times faster than the forces generated by the breathing cycle. The large difference between the frequencies of these two oscillation components allows the low frequency oscillation pressures to be absorbed using high pass filtering techniques while high frequency oscillations are passed to the person's chest. Means to maintain a substantially constant oscillating compressive force upon the chest include a viscous coupling between chest band 12 and linkage 26, a motor for applying the oscillating compressive force and allowing the slow expansion and contraction of chest band 12 to facilitate the person's breathing, and an inflatable pad or very soft cell foam piece mounted on the inner surface of chest band 12.

Figure 4:
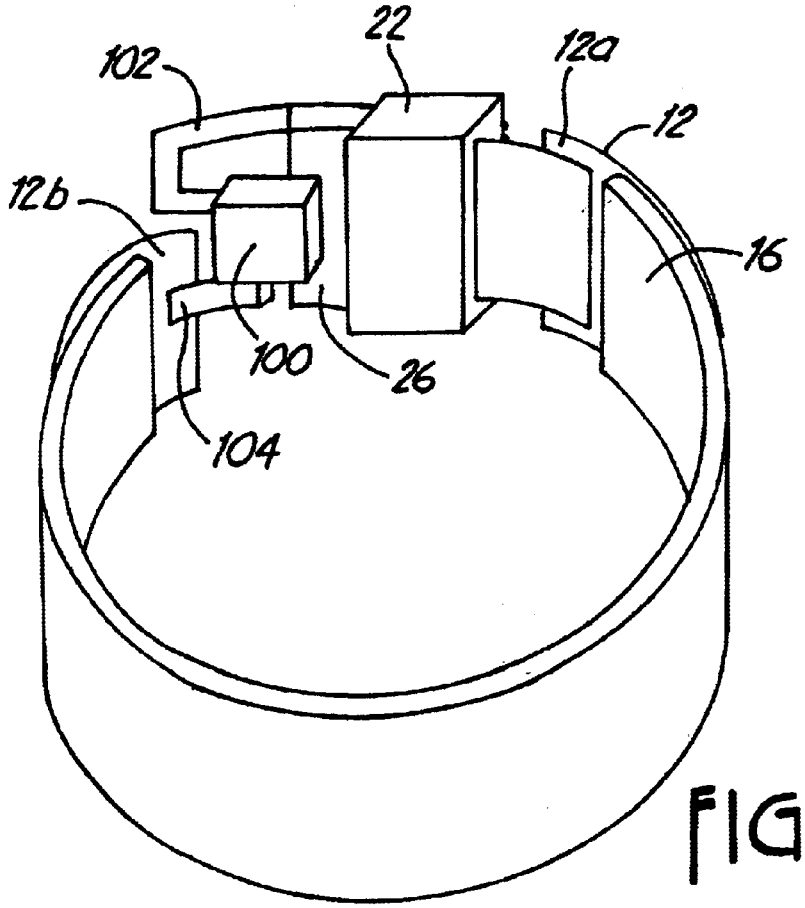
FIG. 4 is a perspective view of a first embodiment of a chest wall oscillator having a coupling 100.

In a first embodiment of the chest wall oscillator, the means to maintain the oscillating compressive force substantially constant is a viscous coupling 100 connecting chest band 12 and linkage 26. FIG. 4 is a perspective view of the first embodiment of the chest wall oscillator having the viscous coupling. One end of viscous coupling 100 is attached to second free end 12*b* of chest band 12 and the other free end of viscous coupling 100 is attached to linkage 26 driving into and out of motor housing 22. The function of viscous coupling 100 is to transfer the rapid oscillation forces from motor 66 located in motor housing 22 to chest band 12 and to expand and contract chest band 12 in response to the slow forces caused by chest movement during the breathing cycle.

Figure 5:
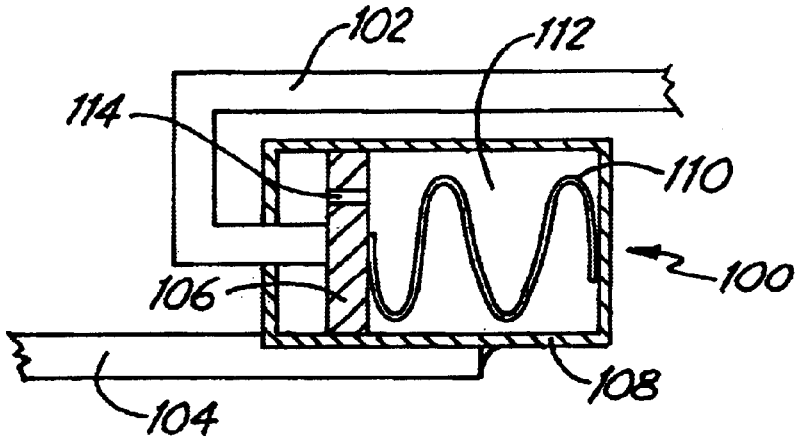
FIG. 5 is a top sectional view of the coupling 100.

FIG. 5 shows a top sectional view of viscous coupling 100. A move link 102 attaches linkage 26 extending into motor housing 22 to one end of viscous coupling 100. A link 104 attaches second end 12*b* of chest band 12 to the other end of viscous coupling 100. Viscous coupling 100 has a piston 106, a cylinder 108 and a spring 110. Move link 102 is joined with piston 106 which is moving within a cylinder 108. Cylinder 108 is joined through link 104 to chest band 12. Cylinder 108 is filled with a viscous fluid 112, which flows through an opening 114 in piston 106 as piston 106 moves within cylinder 108. The sizing of opening 114 and selecting the viscosity of fluid 112 determines the resistence to flow of fluid 112 through opening 114.

Piston 106 can move slowly within cylinder 108 with little force from move link 102. A much higher force is required to move link 102 rapidly. Thereby, the pass of rapidly oscillating forces from motor 66 to the chest band 12 is accomplished while the slow cycling forces caused by the breathing cycle are absorbed with the proper selection of fluid 112 viscosity and opening 114 size. Spring 110 is included in viscous coupling 100 to maintain some tension in chest band 12 so that it remains in contact with the person's chest at all times. Viscous coupling 100 can only make slow movements and these movements are done in rhythm with the expansion and contraction of the person's chest during breathing. The low frequency movement of the viscous coupling 100 maintains a constant force on the person's chest to accommodate breathing. Air bladder 16 may be attached to the inner surface of chest band 12 to work in conjunction with viscous coupling 100 to maintain an even distribution of force upon the person's chest.

Figure 6:
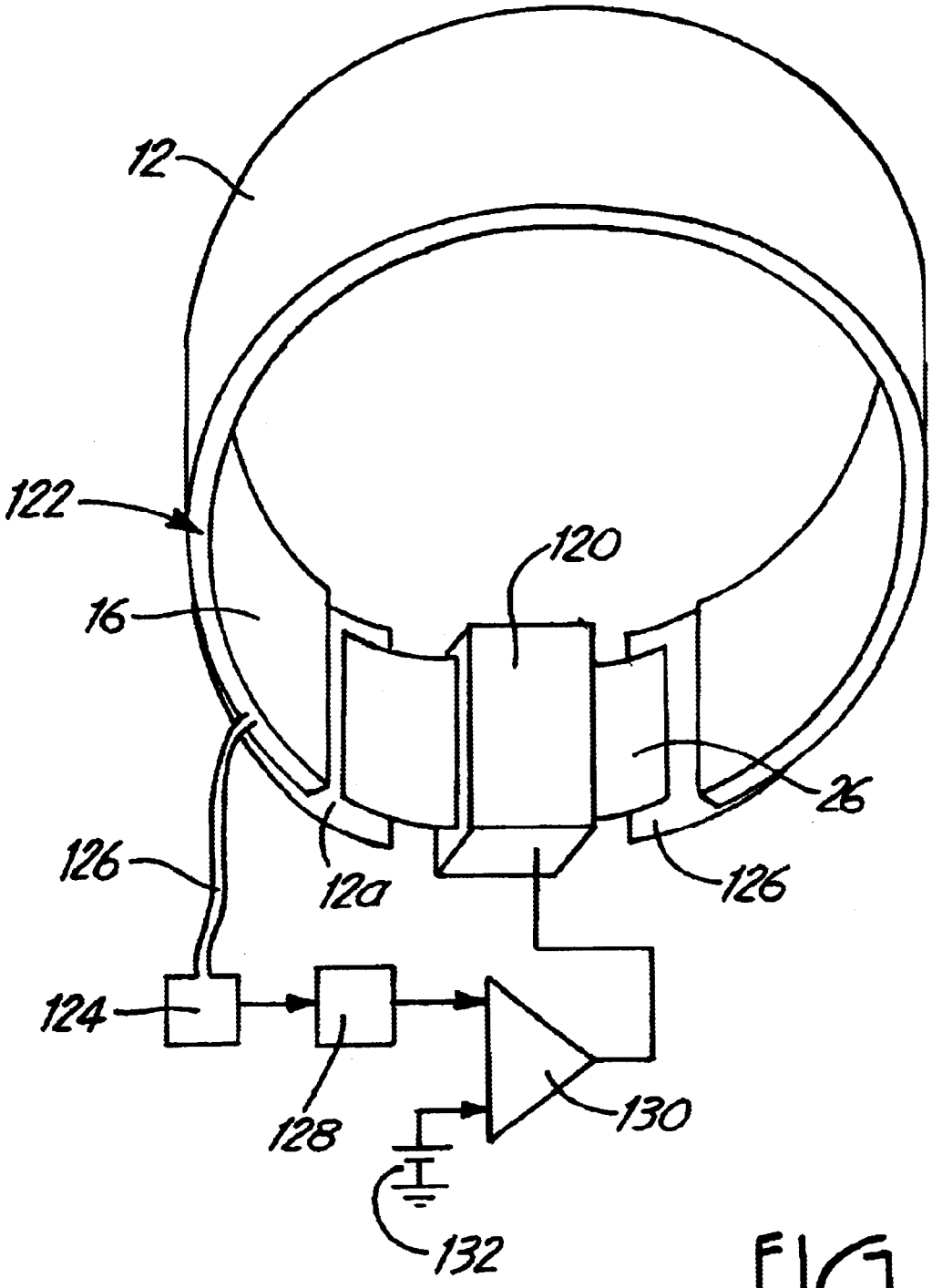
FIG. 6 is a perspective view of a second embodiment of a chest wall oscillator.
Figure 7:
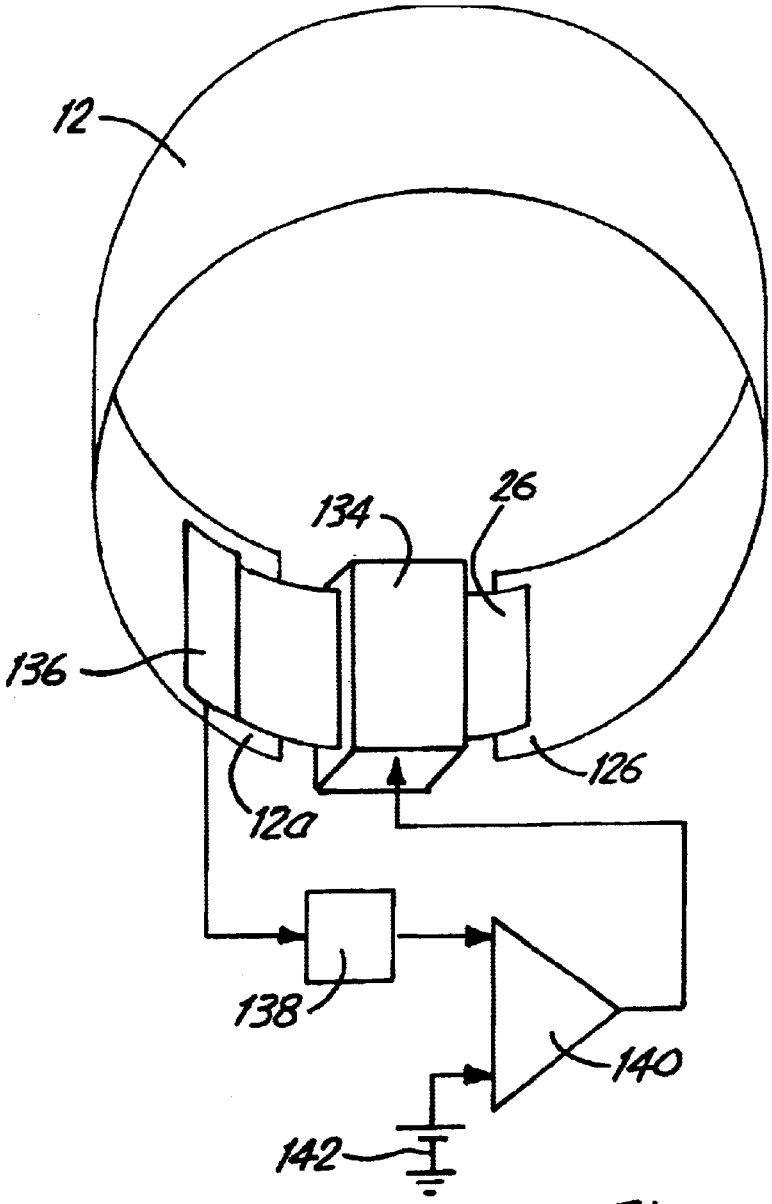
FIG. 7 is a perspective view of a third embodiment of a chest wall oscillator.

FIGS. 6 and 7 show two other embodiments of the chest wall oscillator where the means to maintain the oscillating compressive force substantially constant is a motor 120. Motor 120 has the ability to produce slow expansion and contraction of chest band 12 concurrent with the rapid oscillating compressive forces from movement of linkage 26 into and out of motor housing 22. FIG. 6 shows a second embodiment of chest wall oscillator 10. The chest wall oscillator has air bladder 16 attached to the inner surface of chest band 12 with an airtight space 122 within air bladder 16. A pressure transducer 124 is connected to air bladder 16 by a connection tube 126. Pressure transducer 124 senses the air pressure level within space 122 through connection tube 126. Pressure levels are converted to electrical signals and passed through an electrical low pass filter 128. Pressure levels have two components, low frequency pressure and high frequency pressure. The low frequency pressure component is passed through low pass filter 128 to an amplifier 130 while the high frequency oscillation component is blocked by the filter. Amplifier 130 compares the low frequency pressure to a target constant pressure represented by a voltage source 132. Differences between the target pressure and the low frequency pressure component in space 122 are amplified by amplifier 130 and returned to control the position of motor 120 as in a typical feedback control system. This way the slow pressure cycles in space 122 and therefore on the person's chest are held constant by the action of the feedback control system while the fast pressure cycles of the oscillations are allowed to occur, again producing the desired high pass filter effect.

FIG. 7 shows a third embodiment of the chest wall oscillator with a motor 134. The third embodiment of chest wall oscillator does not have air bladder 16. A sensor 136 is connected to second end 12*b* of chest band 12 and linkage 26. Sensor 136 converts tension forces in chest band 12 to electrical signals. Two types of tension forces are found in chest band 12, low frequency force from chest expansion and contraction during breathing and high frequency oscillating forces from movement of chest band 12 by linkage 26 moving into and out of motor housing 22. Sensor 136 senses the tension forces in chest band 12 and converts the tension forces to electrical signals. The electrical signals are passed through an electrical low pass filter 138. The low frequency forces are passed to an amplifier 140 while the high frequency forces are blocked. Amplifier 140 compares the low frequency forces to a target constant pressure represented by a voltage source 142. Differences between the target force and the low frequency force are amplified by amplifier 140 and returned to control the position of motor 134. This way the slow pressure cycles are held constant and the rapid pressure cycles of oscillations are allowed to occur.

Figure 8:
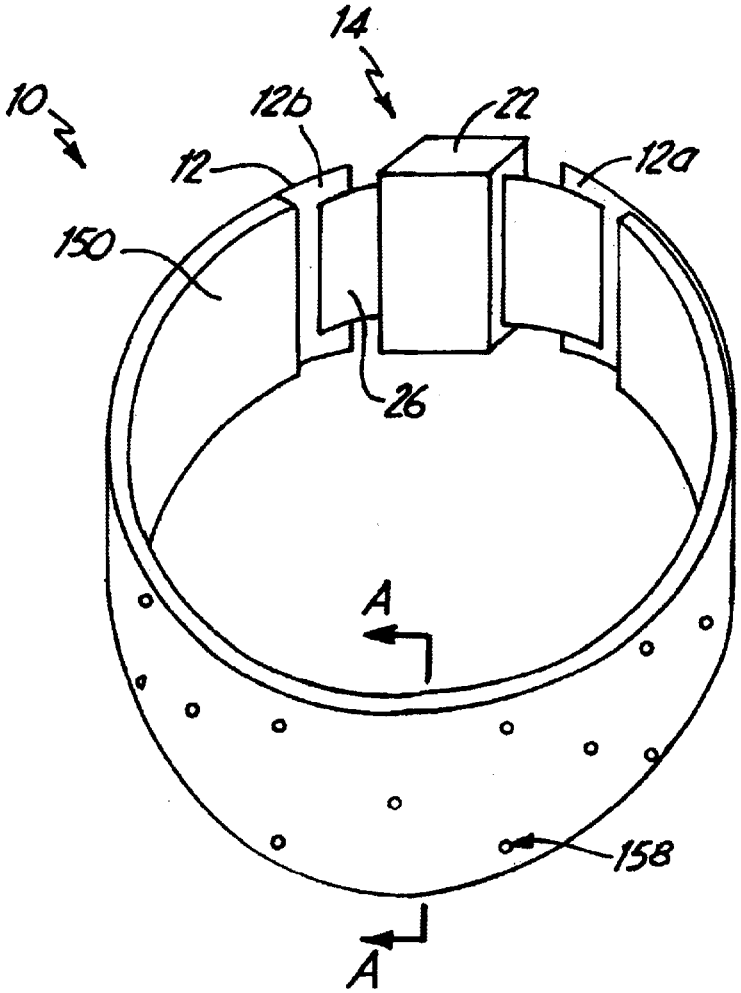
FIG. 8 is a perspective view of a fourth embodiment of a chest wall oscillator.
Figure 11:
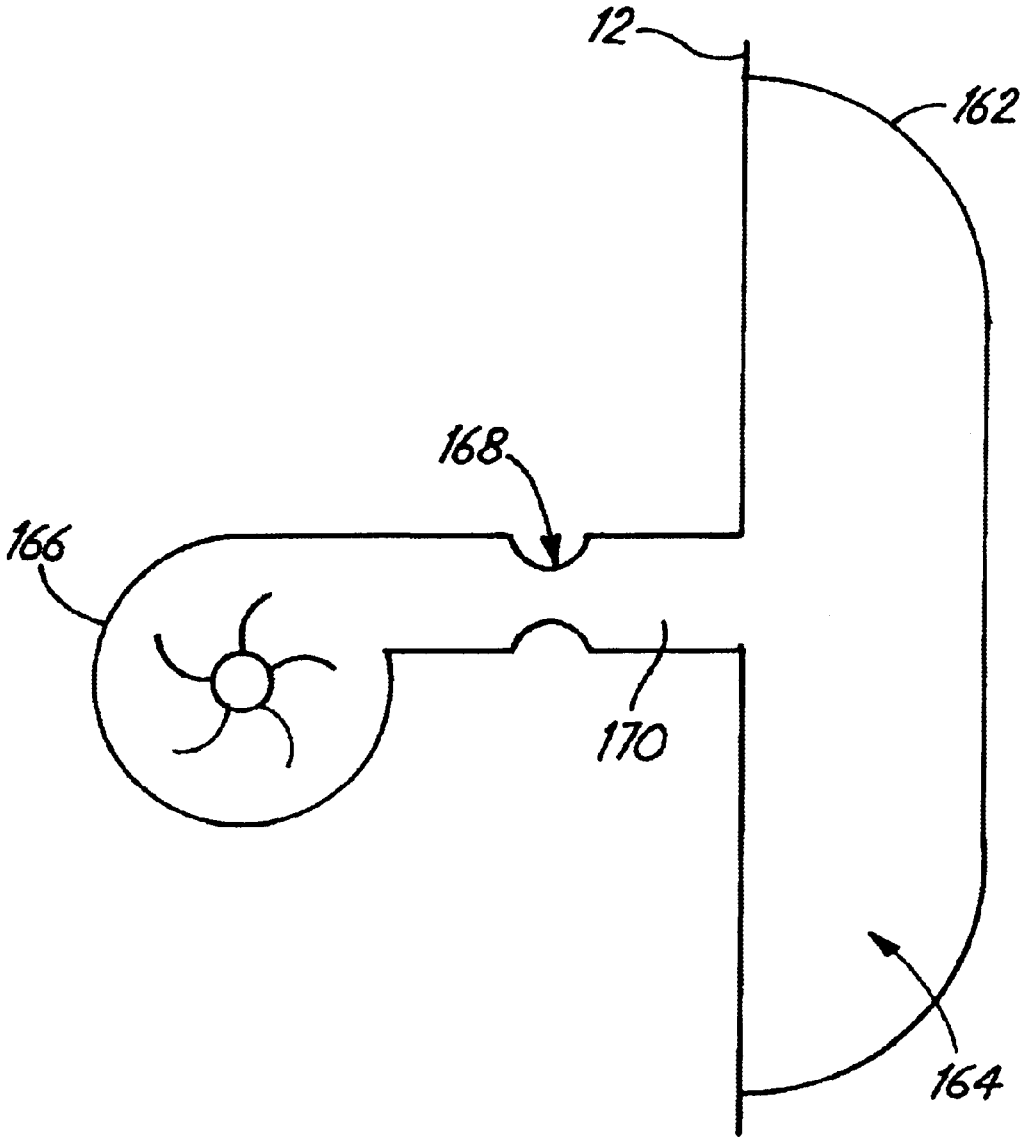
FIG. 11 is a cross-sectional view of a fifth embodiment of a chest wall oscillator taken along line A—A of FIG. 8.

In a fourth embodiment of the chest wall oscillator the means to maintain the oscillating compressive force substantially constant is a foam piece 150 replacing air bladder 16 and inflation device 18. FIG. 8 shows a perspective view of the second embodiment of the chest wall oscillator. Shown in FIG. 8 is chest wall oscillator 10 including chest band 12, drive unit 14, motor housing 22, and foam piece 150. Chest band 12 is made of a non-stretch flexible material with first free end 12*a* attached to motor housing 22 and second free end 12*b* attached to linkage 26. Foam piece 150 is bonded to the inner surface of chest band 12. Alternatively (as seen in FIG. 11), an air bladder 162 is bonded to the inner surface of chest band 12.

Figure 9:
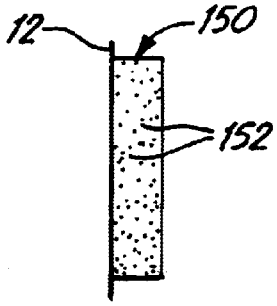
FIG. 9 is a cross-sectional view of the chest wall oscillator of FIG. 8 taken along line A—A of FIG. 8.

FIG. 9 shows a cross-sectional view of the chest wall oscillator of FIG. 8 taken along line A—A of FIG. 8. Foam piece 150 is a very soft cell material that is porous and compressible such that foam piece 150 conforms to the person's chest. The open cells of foam piece 150 are the type that compresses slowly. As force is developed between chest band 12 and the person's chest, foam piece 150 is compressed. A plurality of pores 152 in foam piece 150 are open to the atmosphere and are large enough to maintain a constant force on the chest. As the compressive forces on foam piece 150 change slowly during the breathing cycle, air will exchange between pores 152 and the atmosphere allowing foam piece 150 to compress and relax accommodating chest movement with little change in force on the chest. Pores 152 are also small enough so that the much faster oscillating compressive forces of chest band 12 result in little compression and relaxation of foam piece 150 due to the resistence to air flow of the pore 152 openings. The pore 152 opening sizes are selected to provide optimal discrimination between a rapid oscillating compressive forces and the slow breathing cycle, passing the rapid forces to the person's chest and absorbing the slower forces as with a high pass filter.

Figure 10:
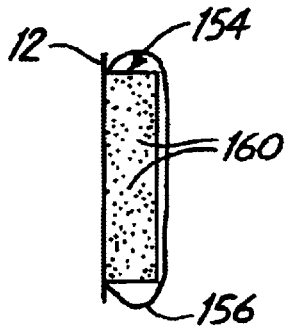
FIG. 10 is a cross-sectional view of an alternate embodiment of the chest wall oscillator of FIG. 8 taken along line A—A of FIG. 8.

FIG. 10 is a cross-sectional view of an alternate embodiment of the fourth embodiment of the chest wall oscillator. In this embodiment, the means to maintain the oscillating compressive forces substantially constant is a foam piece 154 which is similar to foam piece 150, except that a plurality of pores 160 are sized similar or larger and are not used in defining the high pass filtering effect. Foam piece 154 is enclosed by a flexible airtight material 156 which is attached with an airtight bond to chest band 12. A plurality of holes 158 are located in chest band 12 (as shown in FIG. 8). Air moves through holes 158 in response to pressure changes in the chest band 12. The size of holes 158 is chosen to provide the desired high pass filtering effect. Foam piece 154 is made of a very soft cell foam material that is porous and compressible. Air moves through holes 158 at a slow frequency in response to the chest expansions and contractions during breathing. The holes 158 are small enough to block most of the high frequency movement of air that occurs as a result of the movement of band 12 by motor 22. In this way, holes 158 are sized to perform the same function as pores 152 in foam piece 150 of FIG. 9 and thereby providing the desired high pass filter effect.

In a fifth embodiment of the chest wall oscillator the means to maintain the oscillating compressive force substantially constant is an air bladder 162. FIG. 11 is a cross-sectional view of chest band 12 using air bladder 162 to maintain the oscillating compressive forces. Chest band 12 is made of a non-stretch flexible material. Air bladder 162 is made of a flexible airtight material, preferably a flexible polymeric liner, which is bonded to the inner surface of chest band 12. Air bladder 162 forms an airtight space 164 between chest band 12 and the person's chest. Air bladder 162 is inflated by a blower 166 (not shown in FIG. 8) such that the inner surface of air bladder 162 conforms to the person's chest.

A pressure maintaining mechanism such as a blower 166 is connected through restrictor 168 and connection 170 to the air bladder 162 to maintain static air pressure to space 164 and thus a substantially constant force against the chest during use. As the chest expands during inhalation, air flows out of space 164 through opening 170 and restrictor 168 backwards through blower 166. During inhalation by the person, blower 166 holds the static pressure in space 164 substantially constant. As the patient exhales and the chest contracts the air flow path reverses and pressure in space 164 is still maintained substantially constant. Restrictor 168 is sized so that rapid flows caused by the fast oscillation cycles of chest band 12 are substantially blocked and slow flows caused by the breathing cycle of the person are substantially passed through blower 166, thereby producing the desired high pass filter effect. Air bladder 162 is able to vent air slowly and steadily as the person's chest expands and contracts during breathing and a significant portion of the air in space 164 will not exit air bladder 162 during high frequency oscillation of chest band 12.

Although the present invention has been described with reference to preferred embodiments, workers skilled in the art will recognize that changes may be made in form and detail without departing from the spirit and scope of the invention. For example, in other embodiments, battery power pack 24 and motor housing 22 may be combined into a single housing.

What is claimed is:

1. The chest wall oscillator for clearing an air passage of a person, the chest wall oscillator comprising:

a chest band having first and second ends and inner and outer surfaces for placement around the chest of the person;

a drive carried by the chest band for cyclically varying a circumference of the chest band to apply an oscillating compressive force on the chest of the person; and means for maintaining the oscillating compressive force applied by the chest band on the chest of the person at a substantially constant level as the chest expands and contracts during the person's breathing cycle wherein the means for maintaining pass through the oscillating compressive force to the chest and filter a breathing force.

2. The chest wall oscillator of claim 1, wherein the means for maintaining the oscillating compressive force substantially constant comprises a foam piece attached to the inner surface the chest band for engaging the chest of the person, the foam piece including pores having opening sizes selected to provide discrimination between the oscillating compressive force and the breathing force.

3. The chest wall oscillator of claim 2, wherein the foam piece is enclosed by a flexible airtight material.

4. The chest wall oscillator of claim 1, wherein the means for maintaining the oscillating compressive force substantially constant comprises a flexible substantially airtight material carried by the chest band for engaging the chest of the person, the chest band including a plurality of holes with opening sizes selected to provide discrimination between a drive force and the breathing force.

5. The chest wall oscillator of claim 4, and further comprising:

a pressure maintaining mechanism in communication with the flexible substantially airtight material.

6. The chest wall oscillator of claim 5, and further comprising:

a blower in communication with the pressure maintaining mechanism.

7. The chest wall oscillator of claim 1, wherein the drive comprises:

a motor connected to the first end of the chest band; and a linkage connected to the second end of the chest band and driven by the motor to cyclically move the second end of the chest band relative to the first end of the chest band.

8. The chest wall oscillator of claim 7, wherein the means for maintaining the oscillating compressive force substantially constant comprises a viscous coupling connection between the linkage and the second end of the chest band.

9. The chest wall oscillator of claim 8, wherein the viscous coupling further comprises:

a cylinder filled with a viscous fluid; and a piston moving within the cylinder with an opening through which the viscous fluid flows.

10. The chest wall oscillator of claim 7, wherein the means for maintaining the oscillating compressive force substantially constant comprises the motor.

11. The chest wall oscillator of claim 10, and further comprising:

a pressure sensor that senses a tension force in the chest band and signals the tension force to the motor.

12. The chest wall oscillator of claim 10, and further comprising:

an air bladder carried by the chest band for engaging the chest of the person.

13. The chest wall oscillator of claim 12, and further comprising:

a pressure transducer in communication with the air bladder that senses air pressure in the air bladder and signals the air pressure to the motor.

14. The chest wall oscillator of claim 1, wherein the drive comprises:

a motor connected to the first end of the chest band;

an arm connected to the second end of the chest band;

a cam driven by the motor;

a cam follower connected to the arm to translate motion of the cam to motion of the arm; and wherein the first end of the chest band cyclically moves relative to the second end of the chest band.

15. The chest wall oscillator of claim 1, and further comprising:

an air bladder carried by the chest band for engaging the chest of the person.

16. The chest wall oscillator of claim 15, and further comprising:

an inflation device connected to the air bladder.

17. The chest wall oscillator of claim 15, and further comprising:

a pressure relief mechanism in communication with the air bladder.

18. The chest wall oscillator of claim 15, wherein the air bladder is attached to the inner surface of the chest band.

19. The chest wall oscillator of claim 1, wherein the drive cyclically varies the circumference of the chest band at a frequency in a range of about 5 Hz to about 20 Hz.

20. The chest wall oscillator of claim 1, wherein the oscillating compressive force is maintained in a range of about 5 Hz to about 20 Hz and the breathing cycle is about 1 cycle per 4 seconds.

21. The chest wall oscillator of claim 1, and further comprising:

a fastener element on the outer surface of the chest band for connecting the chest band to the drive.

22. A chest wall oscillator for clearing an air passage of a person, the chest wall oscillator comprising:

a chest band having first and second ends and inner and outer surfaces for placement around a chest of the person;

a drive carried by the chest band for cyclically varying a circumference of the chest band to apply an oscillating compressive force on the chest of the person;

means for compensating for chest circumference changes during the person's breathing cycle such that the oscillating compressive force applied on the chest of the person is substantially unaffected by chest circumference changes; and means for passing through the oscillating compressive force to the chest and filtering a breathing force.

23. The chest wall oscillator of claim 22 wherein the means for compensating is connected to the chest band.

24. The chest wall oscillator of claim 22 wherein the means for compensating is connected to the drive.

25. The chest wall oscillator of claim 22, wherein the means for compensating for chest circumference changes during the person's breathing cycle comprises a foam piece attached to the inner surface the chest band for engaging the chest of the person, the foam piece including pores having opening sizes selected to provide discrimination between the oscillating compressive force and the breathing force.

26. The chest wall oscillator of claim 22, wherein the means for compensating for chest circumference changes during the person's breathing cycle comprises a flexible airtight material carried by the chest band for engaging the chest of the person, the chest band including a plurality of holes with opening sizes selected to provide discrimination between a drive force and the breathing force.

27. The chest wall oscillator of claim 22, wherein the means for compensating for chest circumference changes during the person's breathing cycle comprises a viscous coupling connection between the drive and the second end of the chest band.

28. The chest wall oscillator of claim 22, wherein the means for compensating for chest circumference changes during the person's breathing cycle comprises a motor.

29. A chest wall oscillator comprising:

a chest band having first and second ends and inner and outer surfaces, the chest band adapted to be placed around a chest of a person;

a drive connected to the chest band, the drive adapted to apply an oscillating compressive force to the chest band; and a high pass filter operably connected to the chest wall oscillator, the high pass filter adapted to pass through the oscillating compressive force to the chest and filter a breathing force wherein the oscillating compressive force applied on the chest of the person is substantially unaffected by chest circumference changes.

30. A chest wall oscillator comprising:

a chest band having first and second ends and inner and outer surfaces, the chest band adapted to be placed around a chest of a person;

a drive connected to the chest band, the drive adapted to apply an oscillating compressive force to the chest of the person;

means for passing through the oscillating compressive force to the chest and filtering a breathing force; and means for compensating for chest circumference changes during the person's breathing cycle such that the oscillating compressive force applied on the chest of the person is substantially unaffected by chest circumference changes.

31. A chest wall oscillator comprising:

a chest band having first and second ends and inner and outer surfaces, the chest band adapted to be placed around a chest of a person;

a drive adapted to be carried on the person, the chest wall oscillator adapted to apply an oscillating compressive force to the chest of the person;

means for passing through the oscillating compressive force to the chest and filtering a breathing force; and means for compensating for chest circumference changes during the person's breathing cycle such that the oscillating compressive force applied on the chest of the person is substantially unaffected by chest circumference changes.

32. A chest wall oscillator comprising:

a chest band having first and second ends and inner and outer surfaces, the chest band adapted to be placed around a chest of a person;

a drive connected to the chest band, the chest wall oscillator adapted to apply an oscillating compressive force to the chest of the person; and a high pass filter operably connected to the chest wall oscillator, the high pass filter adapted to pass through the oscillating compressive force to the chest and filter a breathing force wherein the high pass filter comprises a foam piece adapted to compensate for the breathing force.

33. The chest wall oscillator of claim 32 wherein the foam piece comprises a soft cell material, the soft cell material being porous and compressible such that the foam piece is adapted to conform to the chest.

34. The chest wall oscillator of claim 32 wherein the foam piece is adapted to substantially absorb the breathing force and not absorb the oscillating compressive force.

35. A chest wall oscillator comprising: a chest band having first and second ends and inner and outer surfaces, the chest band adapted to placed around a chest of a person wherein the chest band comprises a foam piece adapted to compensate for a breathing force, the foam piece including pores having opening sizes selected to provide discrimination between an oscillating compressive force and the breathing force; and a drive connected to the chest band, the chest wall oscillator adapted to apply the oscillating compressive force to the chest of the person.

36. A chest wall oscillator comprising:

a chest band having first and second ends and inner and outer surfaces, the chest band adapted to placed around a chest of a person wherein the chest band comprises a foam piece adapted to compensate for a breathing force and further wherein the foam piece provides a high pass filter effect; and a drive connected to the chest band, the chest wall oscillator adapted to apply an oscillating compressive force to the chest of the person.

37. The chest wall oscillator of claim 36 wherein the oscillating compressive force passes through to the chest and the breathing force is filtered out.

38. A chest wall oscillator comprising:

a chest band having first and second ends and inner and outer surfaces, the chest band adapted to be placed around a chest of a person;

a drive connected to the chest band; and a high pass filter operably connected to the chest band, the high pass filter adapted to pass through an oscillating compressive force to the chest and filter a breathing force wherein the high pass filter comprises a flexible substantially airtight material having a plurality of holes.

39. The chest wall oscillator of claim 38 wherein the flexible substantially airtight material having a plurality of holes encloses a foam piece.

40. The chest wall oscillator of claim 38 wherein the flexible substantially airtight material having a plurality of holes is adapted to substantially absorb the breathing force and not substantially absorb the oscillating compressive force.

41. A chest wall oscillator comprising:

a chest band having first and second ends and inner and outer surfaces, the chest band adapted to placed around a chest of a person wherein the chest band comprises a flexible substantially airtight material having a plurality of holes, the plurality of holes having opening sizes selected to provide discrimination between a drive force and a breathing force; and a drive connected to the chest band.

42. A chest wall oscillator comprising:

a chest band having first and second ends and inner and outer surfaces, the chest band adapted to placed around a chest of a person wherein the chest band comprises a flexible substantially airtight material having a plurality of holes and further wherein the flexible substantially airtight material having a plurality of holes provides a high pass filter effect; and a drive connected to the chest band.

43. The chest wall oscillator of claim 42 wherein the oscillating compressive force passes through to the chest and the breathing force is filtered out.

44. A chest wall oscillator comprising:

a chest band having first and second ends and inner and outer surfaces, the chest band adapted to be placed around a chest of a person;

a drive connected to the chest band; and a high pass filter operably connected to the chest wall oscillator, the high pass filter adapted to pass through an oscillating compressive force to the chest and filter a breathing force wherein the high pass filter comprises a viscous coupling operably connected between the chest band and the drive.

45. The chest wall oscillator of claim 44 wherein the viscous coupling is adapted to compensate for the breathing force.

46. The chest wall oscillator of claim 44 wherein the viscous coupling is adapted to substantially absorb the breathing force and not substantially absorb the oscillating compressive force.

47. A chest wall oscillator comprising:

a chest band having first and second ends and inner and outer surfaces, the chest band adapted to be placed around a chest of a person; a drive connected to the chest band; and a viscous coupling operably connected between the chest band and the drive wherein the viscous coupling is adapted to transfer the oscillating compressive force to the chest and wherein the viscous coupling is adapted to expand and contract the chest band in response to the breathing cycle of the chest.

48. A chest wall oscillator comprising:

a chest band having first and second ends and inner and outer surfaces, the chest band adapted to be placed around a chest of a person; a drive connected to the chest band; and a viscous coupling operably connected between the chest band and the drive wherein the viscous coupling is comprised of a piston having an opening and a cylinder filled with a viscous fluid, the viscous fluid adapted to flow through the opening.

49. The chest wall oscillator of claim 48 wherein the viscous coupling further comprises a spring to maintain tension in the chest band.

50. The chest wall oscillator of claim 48 wherein the opening and viscous fluid are selected to provide discrimination between the drive force and the breathing force.

51. The chest wall oscillator of claim 48 wherein the viscous coupling provides a high pass filter effect.

52. The chest wall oscillator of claim 51 wherein the oscillating compressive force passes through to the chest and the breathing force is filtered out.

53. The chest wall oscillator for clearing an air passage of a person, the chest wall oscillator comprising:

a chest band having first and second ends and inner and outer surfaces for placement around the chest of the person;

a drive carried by the chest band for cyclically varying a circumference of the chest band to apply an oscillating compressive force on the chest of the person; and means for maintaining the oscillating compressive force applied by the chest band on the chest of the person at a substantially constant level as the chest expands and contracts during the person's breathing cycle, the means comprising a high pass filter operably connected to the chest wall oscillator, the high pass filter adapted to pass through the oscillating force to the chest and filter a breathing force.

* * * * *